US006074964A

United States Patent [19]

Hara et al.

[11] Patent Number: 6,074,964

[45] Date of Patent: Jun. 13, 2000

[54] FABRIC AND A PRODUCTION PROCESS THEREFOR

[75] Inventors: Toshinori Hara; Shinichi Okutani, both of Otsu; Jiro Amano, Takatsuki, all of Japan

[73] Assignee: Toray Industries, Inc., Japan

[21] Appl. No.: 08/894,165

[22] PCT Filed: Dec. 19, 1995

[86] PCT No.: PCT/JP95/02598

§ 371 Date: Oct. 14, 1997

§ 102(e) Date: Oct. 14, 1997

[87] PCT Pub. No.: WO97/22747

PCT Pub. Date: Jun. 26, 1997

[51] Int. Cl.[7] ..... B32B 9/04

[52] U.S. Cl. ..... 442/118; 442/155; 427/308; 427/324; 427/389.9; 427/392

[58] Field of Search ..... 442/118, 155; 427/308, 324, 389.9, 392

[56] References Cited

FOREIGN PATENT DOCUMENTS 6-184941 7/1994 Japan .
7-189135 7/1995 Japan .

*Primary Examiner*—Christopher Raimund
*Attorney, Agent, or Firm*—Austin R. Miller

[57] ABSTRACT

An object of the present invention is to provide a fabric exhibiting excellent hygroscopicity, pliable handling touch and shape memory.

An aspect of the present invention for achieving the foregoing object lies in a fabric comprising cellulose fibers, wherein hydrophilic vinyl monomers are graft-polymerized with the cellulose fibers, and the ratio B/W of bending rigidity (B) measured by KES (Kawabata Evaluation System) and weight (W) is 0.0001 or higher and 0.005 or lower.

Another aspect of the present invention lies in a fabric comprising the cellulose fibers and polyester fibers.

A still further aspect of the present invention lies in a fabric comprising cellulose fibers, wherein the percentage of laundry shrinkage is 3% or lower and the ratio B/W of bending rigidity (B) measured by KES and weight (W) is 0.0001 or higher and 0.005 or lower. Another aspect of the present invention lies in a fabric comprising cellulose fibers and polyester fibers, wherein the percentage of laundry shrinkage is 2% or lower and the ratio B/W of bending rigidity (B) measured by KES and weight (W) is 0.0001 or higher and 0.005 or lower.

22 Claims, No Drawings

FABRIC AND A PRODUCTION PROCESS THEREFOR

TECHNICAL FIELD

The present invention relates to a fabric comprising cellulose fibers, and more particularly to a fabric exhibiting excellent hygroscopicity and pliable handling touch, and to a production process therefor.

The present invention as relates to a fabric comprising cellulose fibers and polyester fibers and exhibits hygroscopicity that is equivalent or superior to that of a fabric composed of cellulose fibers, and pliable handling touch, and to a production process therefor.

The present invention relates to a fabric exhibiting excellent shape memory and pliable handling touch, and to a production process therefor.

BACKGROUND ART

Cellulose fiber is known as typical fiber having hygroscopicity, and advanced hygroscopicity thereof is demanded to improve comfort in recent years. A fabric including cellulose fibers and polyester fibers suffers from unsatisfactory hygroscopicity as compared with the fabric including cellulose fibers. Therefore, improved hygroscopicity of the fabric composed of mixed-spun yarns of cotton/polyester is demanded to improve comfort.

To improve the hygroscopicity, it might be considered feasible to employ a modifying process in which hydrophilic vinyl monomers are graft-polymerized with the fabric. The foregoing technique however encounters handling touch of the fabric being stiff because of compounds prepared due to the graft polymerization and left among fibers in a large quantity.

On the other hand, a process for causing a fabric composed of cellulose fibers or a fabric including cellulose fibers to have shape memory has been a resin process using fiber reactant type resin or formaldehyde vapor.

However, to realize satisfactory shape memory, resin needs be supplied in a large quantity. In the foregoing case, there arises a problem in that the handling touch of the fabric becomes stiff. To overcome the foregoing problem, a variety of softening agents has been usually employed. The obtained softening effect however has unsatisfactory.

As disclosed in Japanese Patent Laid-Open No. 7-189135 (1995), a method has been suggested in which a sewed product is subjected to a process for causing the product to have shape memory by using formaldehyde vapor and cellulase is used to process the product. The foregoing method however encounters a difficulty in uniformly enzyme-treating the sewed product, thus resulting in the quality of the sewed product being deteriorated excessively and the strength of the fabric being locally and critically weakened. Moreover, special apparatuses need be provided to perform the process for causing the sewed product to have shape memory and the enzyme process. Therefore, the foregoing method cannot easily be employed.

DISCLOSURE OF THE INVENTION

According to one aspect of the present invention, there is provided a fabric comprising cellulose fibers, comprising hydrophilic vinyl monomers graft-polymerized with the cellulose fibers, wherein ratio B/W of bending rigidity (B) measured by KES (Kawabata Evaluation System) and weight (W) is 0.0001 or higher and 0.005 or lower.

The foregoing fabric is cellulose fiber fabric having improved hygroscopicity and pliable handling touch, each of which cannot be obtained from a conventional cellulose fiber fabric.

We have provided a process for producing a fabric, comprising the step of reducing the weight of a fabric including cellulose fibers before or after the fabric is subjected to a graft polymerization process, in which the fabric is subjected to an impregnation process using a water solution containing hydrophilic vinyl monomers and a polymerization initiator and subjected to heat treatment.

According to another aspect of the present invention, there is provided a fabric comprising cellulose fibers and polyester fibers, comprising hydrophilic vinyl monomers graft-polymerized with the cellulose fibers, wherein the ratio B/W of bending rigidity (B) measured by KES (Kawabata Evaluation System) and weight (W) is 0.0001 or higher and 0.005 or lower.

The foregoing fabric has excellent hygroscopicity equivalent or superior to that of a fabric composed of cellulose fibers and exhibits pliable handling touch, capable of preventing shrinkage as compared with the fabric composed of only cellulose fibers, and exhibits satisfactory strength.

We have provided a process for producing a fabric, comprising the step of reducing weight of a fabric comprising polyester fibers and cellulose fibers before or after the fabric is subjected to a graft polymerization process, in which the fabric is subjected to impregnation using a water solution containing hydrophilic vinyl monomers and a polymerization initiator, and subjected to heat treatment.

According to a still further aspect of the present invention, there is provided a fabric comprising cellulose fibers, wherein the percentage of laundry shrinkage is 3% or lower and the ratio B/W of bending rigidity (B) measured by KES (Kawabata Evaluation System) and weight (W) is 0.0001 or higher and 0.005 or lower.

The foregoing fabric is a fabric having good shape memory and pliable handling touch.

We have provided a process for producing a fabric, comprising the step of reducing the weight of cellulose fibers forming the fabric comprising the cellulose fibers before or after the cellulose fibers are crosslinked.

According to another aspect of the present invention, there is provided a fabric comprising cellulose fibers and polyester fibers, wherein the percentage of laundry shrinkage is 2% or lower and the ratio B/W of bending rigidity (B) measured by KES (Kawabata Evaluation System) and weight (W) is 0.0001 or higher and 0.005 or lower.

The foregoing fabric has good shape memory, pliable handling touch, is capable of preventing shrinkage as compared with a fabric composed of only cellulose fibers, and exhibits satisfactory strength.

We have also provided a process for producing a fabric, comprising the step of reducing the weight of cellulose fibers forming the fabric including cellulose fibers and polyester fibers before or after the cellulose fibers are crosslinked.

BEST MODE FOR CARRYING OUT THE INVENTION

According to one aspect of the present invention, there is provided a fabric comprising cellulose fibers, in which hydrophilic vinyl monomers are graft-polymerized with the cellulose fibers, and the ratio B/W of bending rigidity (B) measured by using a KES (Kawabata Evaluation System) and weight (W) is 0.0001 or higher and 0.005 or lower.

In the present invention, the cellulose fiber is exemplified by natural cellulose fiber, such as cotton or hemp, or regenerated cellulose, such as rayon, polynosic, cupro or tencel. However, the cellulose fiber is not limited to the foregoing.

The fabric comprising the cellulose fibers is exemplified by a woven fabric, a knitted fabric or its sewed product substantially composed of the cellulose fibers. Among the foregoing materials, the woven fabric, knitted fabric or its sewed product is preferably employed, the woven fabric or its sewed product is more preferably employed.

The fabric according to the present invention comprises the cellulose fibers to which the hydrophilic vinyl monomers are graft-polymerized. It is preferable that the hydrophilic vinyl monomers are graft-polymerized in a fiber which composes the cellulose fibers. Such graft-polymerization in the fiber improves the durability of the hygroscopicity and does not prevent the handling of the woven/knitted fabric. Graft-polymerization in the fiber which composes the cellulose fibers can be confirmed by, for example, cross section dyeing. The cross section dyeing is performed as follows: a fiber bundle imbedded with paraffin is cut in a direction perpendicular to the fiber axis so that a section is made. The imbedded section is removed by an organic solvent or the like and then dyed with an appropriate dye (for example, basic dye), followed by being washed with water. By observing the section with an optical microscope, graft-polymerization to the inside of the fiber can be confirmed.

The hydrophilic vinyl monomer according to the present invention is a monomer having a polymerizable vinyl group in the molecular structure thereof, and as well as containing an acid group of, for example, carboxylic acid or sulfonic acid and/or its salt and a hydrophilic group, such as a hydroxyl group or an amide group.

Specifically, an acrylate monomer, such as acrylic acid, sodium acrylate, aluminum acrylate, zinc acrylate, calcium acrylate or magnesium acrylate; 2-acrylamide-2-methylpropane sulfonic acid; methacrylic acid; allyl alcohol; sodium allyl sulfonate; acryl amide; sodium vinyl sulfonate; sodium metharylsulfonate; or sodium styrene sulfonate may be employed. Any of the foregoing materials may be used individually, or two or materials may be used together.

Among the foregoing materials, it is preferable that a monomer, such as 2-acrylamide-2-methylpropane sulfonic acid and/or its sodium salt or sodium allylsulfonate, etc., having sulfonic acid and/or its salt in the molecular structure thereof be employed because of its excellent reactivity.

It is preferable that the reaction ratio of the hydrophilic vinyl monomer with respect to the fabric be 1 wt % or higher and 20 wt % or lower in view of maintaining the handling touch of the fabric and obtaining excellent hygroscopicity. It is further preferable that the ratio be 3 wt % or higher and 17 wt % or lower, and still further preferable that the ratio be 5 wt % or higher and 15 wt % or lower. Note that the reaction ratio in this description is a ratio (wt %) of the weight of the fabric increased due to the graft-polymerization and it can be calculated such that 100×[(absolute dry weight of the fabric after graft-polymerized)−(absolute dry weight of the fabric before graft-polymerized)]/(absolute dry weight before graft-polymerized).

It is preferable that the fabric according to the present invention has ΔMR expressed by a value obtained by subtracting hygroscopic coefficient MR1 (%) of the fabric at temperature of 20° C. and humidity of 65% from hygroscopic coefficient MR2 of the fabric at temperature of 30° C. and humidity of 90% satisfies the following equation:

$$4<\Delta MR\leqq 14$$

The hygroscopic coefficient MR1 (%) of the fabric at temperature of 20° C. and humidity of 65% can be considered to be the hygroscopicity of clothes under a standard environment. The hygroscopic coefficient MR2 (%) of the fabric at temperature of 30° C. and humidity of 90% can be considered to be the hygroscopicity of clothes realized after slight exercise.

Note that ΔMR of the fabric composed of only cellulose fibers in which the hydrophilic vinyl monomers are not graft-polymerized is not more than 4.

As compared with this, the fabric according to the present invention has ΔMR larger than 4 because the hydrophilic vinyl monomers are graft-polymerized. Thus, excellent hygroscopicity can be obtained as compared with the conventional fabric composed of only cellulose fibers.

In the present invention, the KES (Kawabata Evaluation System) measurement is, as disclosed in vol. 26, No. 10, P721–P728 (1973), Magazine of Textile Machinery Society (Textile Engineering) written by Sueo Kawabata, measurement of resiliency at each curvature realized when the fabric is bent by using the KES bending rigidity measuring machine (manufactured by KATO TECH). An assumption is made that the average value of the resiliency from a curvature of 0.5 to a curvature of 1.5 is B (unit: $g\cdot cm^2/cm$). Moreover, the foregoing measurement is performed in both longitudinal and lateral directions of the fabric and an assumption is made that the average value is B. Then, ratio B/W of the foregoing value B and weight W (unit: $g/m^2$) of the fabric is obtained.

The fabric according to the present invention needs to have a ratio B/W of the bending rigidity (B) measured by the KES (Kawabata Evaluation System) measurement and the weight (W) of 0.0001 or higher and 0.005 or lower.

If B/W measured by the KES measurement is larger than 0.005, the handling touch becomes stiff and the quality deteriorates. It is preferable that the foregoing B/W be 0.004 or lower, more preferably 0.003 or lower.

An aspect of a process of producing the fabric will now be described.

Before or after performing a graft polymerization process in which a fabric, obtained by weaving, knitting etc., such as a woven fabric, knitted fabric or a unwoven fabric comprising the cellulose fibers is subjected to an impregnation process using water solution containing hydrophilic vinyl monomers and a polymerization initiator and then to heat treatment, weight reduction is performed so that the fabric according to the present invention is obtained.

As a method of subjecting the fabric including the cellulose fibers to the impregnation process using the water solution containing the hydrophilic vinyl monomers and the polymerization initiator, a method for impregnating the fabric for a predetermined time or a padding method may be employed, for example. The impregnation temperature is not limited particularly and therefore it may be performed at room temperature.

In the present invention, the polymerization initiator is preferably a polymerization initiator for use generally in radical polymerization. Specifically, it is preferable to use peroxide, such as ammonium persulfate or dibenzoyl peroxide, azo catalyzer, or cerium catalyzer.

The concentration of the hydrophilic vinyl monomers in the water solution containing the hydrophilic vinyl monomers and the polymerization initiator is not limited particularly. In view of efficiently performing reactions, it is preferable that the concentration be 10 wt % or higher and 30 wt % or lower. It is further preferable that the concentration be 13 wt % or higher and 27 wt % or lower, and it is still further preferable that the same is 15 wt % or higher and 25 wt % or lower.

The concentration of the polymerization initiator in the water solution containing the hydrophilic vinyl monomers and the polymerization initiator is not limited particularly. In view of efficiently performing reactions, it is preferable that the concentration be 1 wt % or higher and 5 wt % or lower with respect to the hydrophilic vinyl monomers, more preferably 2 wt % or higher and 4 wt % or lower.

In view of preventing deterioration in the strength properties of the fabric including the cellulose fibers and to efficiently perform the reactions, it is preferable that the pH of the water solution containing the hydrophilic vinyl monomers and the polymerization initiator be 6 or more and 12 or less, more preferably that the pH being 7 or more and 11 or less.

In the process of producing the fabric according to the present invention, the heat treatment is performed after the impregnation process. The heat treatment is required to perform the graft-polymerization reaction. The heat treatment is not particularly limited and therefore dry heat treatment or wet heat treatment may be employed.

The temperature of the heat treatment for performing the graft-polymerization is not limited particularly. In view of efficiently performing reactions, it is preferable that the heat treatment be performed at temperature of 80° C. or higher and 200° C. or lower. The heat treatment is performed in one step or two or more steps. The time, for which the heat treatment is performed, is determined in consideration of the heat treatment temperature in relation to the graft reaction rate. It is preferable that the time be 20 seconds or longer and 5 minutes or shorter.

In the graft polymerization process, it is preferable that washing be performed to remove non-reacted monomers allowed to adhere to the fabric and polymers which are not graft-polymerized to the cellulose. The washing method is not limited particularly and therefore water washing or hot water washing may be employed. In view of improving the washing efficiency, it is preferable that the hot water washing be employed. When the weight reduction is performed after the graft polymerization process has been performed, the weight reduction as well as has the washing effect.

In addition to the graft polymerization process, weight reduction needs be performed. The weight reduction is a process in which a portion of fibers forming a fabric is decomposed and removed to reduce the weight of the fabric.

The weight reduction of the cellulose fibers is exemplified by a process using a cellulase or hydrolyzing. It is preferable that the process using cellulase be employed. As the cellulase, an enzyme obtained by culturing bacteria of Tricoderma genus, Fumicola genus, Aspergills genus or Bacillus genus may be employed. The foregoing cellulase has been placed on the market and may be used as it is.

In the present invention, the reduction ratio in the weight reduction is the ratio of the portion decomposed and removed before and after the process. Specifically, it can be calculated as (reduced weight/weight before the process)× 100.

In the weight reduction according to the present invention, the reduction is performed with physical stimulation added to the fabric so that a fabric having excellent handling is realized. For example, a liquor flow dyeing machine or an air flow dyeing machine is used to physically stimulate, for example, beat, crumple or rub, the fabric at the time of reducing the weight of the fabric. The foregoing process is considered to form spaces among fibers of the fabric so that a pliable handling touch is given to the fabric. As means for strengthening the physical stimulation, it is effective to cause the running fabric to come in contact with a material, such as ceramic, having considerable projections and pits and therefore exhibiting a large coefficient of friction. In view of the foregoing, it is further preferable that the weight reduction be performed by using a ceramic nozzle adapted to the liquor flow dyeing machine or the air flow dyeing machine or a similar material employed in the portion, through which the fabric passes at high speed, or a partition plate disposed in the same.

In the conventional weight reduction using a wince or the like, satisfactory strong physical stimulation, such as crumpling, beating and rubbing cannot be realized and therefore pliable handling touch cannot be obtained. In the foregoing case, a poor B/W of about 0.006 or lower can be obtained.

In view of attaining flexibility and maintaining strength, it is preferable that the reduction ratio be 3% or higher and 10% or lower.

As the process of reducing the weight, it is preferable that the process be performed in such a manner that the fabric is dipped in water solution in which the cellulase is contained at a concentration of 1 g/l to 30 g/l at temperature of 30° C. or higher and 90° C. or lower.

The processing order of the graft polymerization and the weight reduction may be performed such that the weight reduction is performed after the graft polymerization has been performed or the weight reduction is performed first. In the case where the weight reduction is performed after the graft polymerization has been performed, further spaces can be created among the fibers and thus the effect of pliable handling touch can be improved.

Another aspect of the fabric according to the present invention lies in a fabric including cellulose fibers and polyester fibers, wherein hydrophilic vinyl monomers are graft-polymerized with the cellulose fibers and the ratio B/W of the bending rigidity (B) measured by the KES (Kawabata Evaluation System) measurement and the weight (W) is 0.0001 or higher and 0.005 or lower. It is preferable that the ratio B/W be 0.004 or lower, more preferably 0.003 or lower.

The foregoing fabric has hygroscopicity equivalent or superior to that of a fabric composed of cellulose fibers, exhibits pliable handling touch, capable of preventing shrinkage as compared with the fabric composed of only cellulose fibers, and attains excellent strength property. In view of the foregoing, it is preferable that the content of the cellulose fibers be 10 wt % or higher or 90 wt % or lower and the content of the polyester fibers be 90 wt % or higher or 10 wt % or lower. More preferably, the content of the cellulose fibers is 20 wt % or higher or 80 wt % or lower, and the content of the polyester fibers is 80 wt % or higher or 20 wt % or lower, further more preferably the content of the cellulose fibers is 30 wt % or higher or 70 wt % or lower and the content of the polyester fibers is 70 wt % or higher or 30 wt % or lower.

In the present invention, the polyester fiber is composed of a polyester polymer having fiber forming characteristic such as polyethylene terephthalate. The polyester polymer above includes a copolymer as well as homopolymer.

The fabric comprising the cellulose fibers and the polyester fibers is exemplified by a woven fabric, knitted fabric or a unwoven fabric or its sewed product, obtained by weaving, knitting, etc., using yarns formed by mix-spinning or mix-texturing polyester fibers and cellulose fibers, In particular, it is preferable that the woven fabric, knitted fabric or its sewed product be employed, more preferably the woven fabric or its sewed product be employed.

Although the fabric of the foregoing aspect according to the present invention includes polyester fibers, they are used together with the cellulose fibers to which the hydrophilic vinyl monomers are graft-polymerized as described above. Therefore, excellent hygroscopicity can be obtained.

It is preferable that the foregoing fabric has ΔMR expressed by a value obtained by subtracting hygroscopic coefficient MR1 (%) of the fabric at temperature of 20° C. and humidity of 65% from hygroscopic coefficient MR2 (%) of the fabric at temperature of 30° C. and humidity of 90% and satisfying the following equation:

$$0.04\times(100-x)<\Delta MR\leqq 0.14\times(100-x)$$

wherein x is the ratio (wt %) of the polyester fibers in the fabric.

It is preferable that the fabric in the foregoing aspect has a shrinkage ratio of 3% or lower. It is more preferable that the shrinkage ratio be 2% or lower.

Since the hydrophilic vinyl monomers are graft-polymerized with the cellulose fibers in the foregoing fabric, excellent hygroscopicity can be realized. On the other hand, the hydrophilic vinyl monomers are not graft-polymerized with the hydrophobic polyester fibers. Thus, the shrink resistance, which is the characteristic of the polyester fiber, can be maintained.

The foregoing fabric can be obtained by reducing the weight of the fabric comprising the polyester fibers and the cellulose fibers as described above before or after the graft polymerization is performed in which the fabric is subjected to impregnation using water solution containing the hydrophilic vinyl monomers and the polymerization initiator and then to heat treatment.

The thus-obtained fabric does not substantially deteriorate the excellent shrink resistance of the polyester fibers and exhibits satisfactory hygroscopicity superior to that of the conventional fabric including polyester fibers and cellulose fibers.

The method of reducing the weight of the cellulose fibers is similar to that of the foregoing aspect. The method of reducing the weight of the polyester fibers may be weight reduction using an alkali compound, such as sodium hydrate.

As the process of reducing the weight, it is preferable that the process be performed in such a manner that the fabric is dipped in water solution in which the cellulase is contained at a concentration of 1 g/l or more and 30 g/l or less and the process is performed at temperature of 30° C. or higher and 90° C. or lower. Also it is preferable that the fabric be dipped in 50° C. or higher and 200° C. or lower water solution containing the alkali compound at a concentration of 10 g/l or more and 300 g/l or less.

In view of causing the fabric to have flexibility and as well as maintaining strength, it is preferable that the ratio of weight reduction of the cellulose fibers be 3% or higher and 10% or lower and the ratio of weight reduction of the polyester fibers be 3% or higher and 20% or lower.

Another aspect of the fabric according to the present invention lies in a fabric comprising cellulose fibers, and having a percentage of laundry shrinkage of 3% or lower and a ratio B/W of the bending rigidity (B) measured by the KES (Kawabata Evaluation System) measurement and the weight (W) of 0.0001 or higher and 0.005 or lower. It is preferable that the B/W be 0.004 or lower, more preferably 0.003 or lower.

The fabric of the foregoing aspect is a fabric having shape memory and pliable handling touch.

The percentage of laundry shrinkage in the present invention is a value measured in accordance with JIS L1042 or a value measured by a method according to JIS L1042 enabling a similar result to be obtained but the washing testing machine or the processing conditions are changed.

The percentage of laundry shrinkage of the fabric in the foregoing aspect need be 3% or lower. If the percentage of laundry shrinkage is higher than 3%, the shape memory deteriorates. It is preferable that the percentage of laundry shrinkage be 2% or lower, more preferably 1% or lower.

The fabric in the foregoing aspect can be obtained by a process for causing the fabric to have shape memory such that cellulose forming the cellulose fibers is crosslinked to prevent wrinkles of washed fabric and by the weight reduction of the cellulose fibers.

The method of crosslinking the cellulose fibers is exemplified by a process in which the fabric is processed with fiber reactant type resin and a process in which the fabric is exposed to formaldehyde vapor so as to be subjected to heat treatment in presence of a catalyzer.

The fiber reactant type resin above is any one of dimethylol ethylene urea, dimethylol uron, dimethylol triazone, dimethylol propane urea, dimethylol dihydroxyethylene urea or the like. As the method of processing the fabric with the fiber reactant type resin, it is preferable to employ a method in which water solution of the foregoing resin is supplied to the fabric by padding or the like together with a catalyzer, followed by being subjected to heat treatment at temperature of 80° C. or higher and 200° C. or lower. As the catalyzer, inorganic metal salt, such as magnesium chloride, may be employed.

On the other hand, formaldehyde vapor can be generated by heating water solution of formaldehyde, paraformaldehyde or the like. It is preferable that the heat treatment, to be performed after the fabric is exposed to formaldehyde vapor, be performed at 60° C. or higher and 160° C. or lower. As the catalyzer for use in this case, an acidic substance, such as sulfuric acid or sulfurous acid, may be employed.

Crosslinking using the fiber reactant type resin and/or formaldehyde can be detected by a variety of usual analyzing methods, such as liquid chromatography or NMR.

In addition to the shape memory process, the weight reduction is performed. The weight reduction may be the foregoing weight reduction.

In view of giving flexibility to the fabric and maintaining the strength, it is preferable that the weight reduction ratio of the cellulose fibers be 3% or higher and 10% or lower.

As the weight reduction, the fabric may be dipped in the foregoing water solution, in which the concentration of the enzyme is 1 g/l or more and 30 g/l % and the process is performed at temperature of 30° C. or higher and 90° C. or lower.

In the present invention, the processing order of the cellulose crosslinking and the weight reduction may be performed such that the weight reduction is performed after the crosslinking has been performed or the weight reduction may be performed first. An advantage realized in the case where the shape memory process is performed first is that the weight reduction causes large spaces to be created among the fibers and thus the effect of pliable handling touch can be improved. If the weight reduction is performed first, the created spaces among fibers are contracted at the time of performing the shape memory process and therefore the effect of pliable handling touch decreases. However, the shape memory effect can be improved. Thus, the order may be arbitrarily determined to realize the desired characteristics.

Although a sewed product is usually subjected to the shape memory process, in which the fabric is exposed to formaldehyde vapor so as to be subjected to heat treatment in presence of catalyzer, it is preferable that a pre-sewing fabric be subjected to the weight reduction according to the present invention in place of subject the sewed product to the same. The reason for this is that it is difficult to uniformly process the sewed product in the case where the sewed product is processed. In the foregoing case, the quality of the sewed product can be deteriorated excessively or the strength critically and locally deteriorates. Since the shape memory process and weight reduction of the sewed product require special apparatuses, they cannot easily be performed. In the present invention, since the pre-sewing fabric is subjected to the weight reduction, the foregoing problem can be overcome.

A still further aspect of the fabric according to the present invention lies in a fabric comprising cellulose fibers and polyester fibers, wherein the percentage of laundry shrinkage is 2% or lower and the ratio B/W of the bending rigidity (B) measured by the KES (Kawabata Evaluation System) measurement and the weight (W) is 0.0001 or higher and 0.005 or lower. It is preferable that B/W be 0.004 or lower, more preferably 0.003 or lower.

The foregoing fabric has shape memory, flexible handling, capable of preventing shrinkage as compared with a fabric composed of only cellulose fibers and exhibits excellent strength property.

The foregoing fabric includes a woven fabric, knitted fabric, unwoven fabric or its sewed product, obtained by weaving, knitting, etc., using yarns formed by mix-spinning or mix-texturing polyester fibers and cellulose fibers.

Since the foregoing fabric includes the polyester fibers, shrinkage can be prevented as compared with the fabric composed of only cellulose fibers, excellent shape memory can be realized and satisfactory strength property can be obtained even if the weight reduction is performed. In view of the foregoing, it is preferable that the content of the cellulose fibers be 10 wt % or higher or 90 wt % or lower and the content of the polyester fibers be 90 wt % or higher or 10 wt % or lower, more preferably the content of the cellulose fibers be 20 wt % or higher or 80 wt % or lower and the content of the cellulose fibers be 80 wt % or higher or 20 wt % or lower. Further preferably, the content of the cellulose fibers is 30 wt % or higher or 70 wt % or lower and the content of the polyester fibers is 70 wt % or higher or 30 wt % or lower.

The fabric in the foregoing aspect need have a percentage of laundry shrinkage of 2% or lower. If the percentage of laundry shrinkage is higher than 2%, the shape memory deteriorates. It is preferable that the percentage of laundry shrinkage be 1%, more preferably 0.5% or lower.

The foregoing fabric can be obtained by subjecting a fabric including the cellulose fibers and the polyester fibers to the foregoing shape memory process and the weight reduction.

The method of reducing the weight of the cellulose fibers is similar to that of the foregoing aspect. The method of reducing the weight of the polyester fibers may be weight reduction by using an alkali compound, such as sodium hydrate.

It is preferable that the weight reduction be performed such that the fabric is dipped in water solution, in which the concentration of the cellulase is 1 g/l or more and 30 g/l or less, and the process is performed at temperature of 30° C. or higher and 90° C. or lower. It is preferable that the fabric be dipped in water solution, in which the concentration of the alkali compound is 10 g/l or more and 300 g/l or less and the process is performed at temperature of 50° C. or higher and 200° C. or lower.

In view of giving flexibility to the fabric and maintaining the strength of the same, it is preferable that the weight reduction ratio of the cellulose fibers be 3% or higher and 10% or lower and the weight reduction ratio of the polyester fibers be 3% or higher and 20% or lower.

The reduction ratio in the weight reduction is a ratio of the portion decomposed and removed before and after the process. Specifically, it can be calculated such that (reduced weight/weight before the process)×100.

The processing order of the cellulose crosslinking process and the weight reduction may be performed such that the weight reduction is performed after the crosslinking process has been performed or the weight reduction may be performed first. Because of the same reason as that above, the sewed product is usually subjected to the shape memory process, in which the fabric is exposed to formaldehyde vapor so as to be subjected to heat treatment in presence of a catalyzer. In the present invention, it is preferable that the pre-sewing fabric be subjected to the weight reduction in place of subjecting the sewed product to the same.

EXAMPLES

The present invention will now be described further specifically with embodiments. The characteristic values in the examples were obtained by the following methods.

(1) Hygroscopicity

The hygroscopic coefficient was obtained from change in the weight from the absolute weight of the fabric to the weight of the fabric after it had been allowed to stand in an atmosphere that the temperature was 20° C. and the humidity was 65% or that the temperature was 30° C. and the humidity was 90% in thermo-hygrostat for 24 hours in accordance with the following equation:

Hygroscopic Coefficient (%)=100×[(weight of fabric after allowed to stand at constant temperature and humidity)−(absolute dry weight of fabric)]/(absolute dry weight of fabric)

By using hygroscopic coefficient MR1 obtained from the foregoing equation and realized under conditions that the temperature was 20° C. and humidity was 65% and hygroscopic coefficient MR2 realized under conditions that the temperature was 30° C. and the humidity was 90%, ΔMR was calculated in accordance with the following equation.

$$\Delta MR = MR2 - MR1$$

where the more the ΔMR is, the hygroscopicity and the comfort improve.

(2) Reaction Ratio

The reaction ratio was calculated from the absolute dry weight of the fabric before graft-polymerized and the absolute dry weight of the fabric after it had been graft-polymerized in accordance with the following equation:

Reaction Ratio (%)=100×[(absolute dry weight of fabric after graft-polymerized)−(absolute dry weight of fabric before graft-polymerized)]/(absolute dry weight of fabric before graft-polymerized)

(3) Weight Reduction Ratio

The weight reduction ratio was calculated from the absolute dry weight of the fabric before its weight was reduced and the absolute dry weight of the processed fabric in accordance with the following equation:

Weight Reduction Ration (%)=100×(absolute dry weight of fabric before it was processed−absolute dry weight of processed fabric)/(absolute dry weight of fabric before it was processed)

(4) B/W

The ratio B/W was obtained by measurement of the average value B (unit: $g \cdot cm^2/cm$) of the longitudinal and lateral bending rigidities measured by the KES (Kawabata Evaluation System) measuring machine and the weight (unit: $g/m^2$) of the fabric was measured.

(5) Percentage of Laundry Shrinkage

The percentage of laundry shrinkage was measured by using a home washing machine under the following conditions to obtain results similar to those obtainable from the percentage of laundry shrinkage test method per JIS-L1042:

Three test samples having size of about 50 cm×50 cm were obtained, each of which was provided with three marks each having a length of 300 mm and formed at intervals of 150 mm. Then, 25 l of liquid containing, at a concentration of 0.2%, a detergent "Zabu" (registered trademark Kao Kabushiki Kaisha) was injected into a home washing machine (VH-1150 manufactured by Toshiba) and an adjustment was performed such that the weight, which is the addition of the test samples and an additional cloth, was about 500 g, followed by being washed at 40° C. for 25 minutes. Then, rinsing was performed at 40° C. for 10 minutes, followed by performing dehydration by a dehydrator. Then, the test samples were ejected without being squeezed and put between dry filtration sheets so as to be slightly dehydrated. Then, the samples were naturally dried on a metal net placed horizontally. Finally, the test samples were placed on a plain frame to obtain an average value of the three samples. The shrinkage ratio was calculated in accordance with the following equation and the obtained value was expressed as an average value of the three samples:

Shrinkage Ratio (%)=(300−$L$)/300×100 where L is an average value (mm) of the lengths between longitudinal or lateral marks after the process.

Example 1

A scoured and bleached cotton woven fabric (yarn arrangement: warp yarns were No. 45 count yarns, weft yarns were No. 45 count yarns, plain woven fabric, weaving density: 115 warp yarns/inch×76 warp yarns/inch, weight: 110 $g/m^2$) was supplied by padding with water solution containing 2-acrylamide-2-methylpropanesulfonic acid by a concentration of 20% and ammonium persulfate by a concentration of 0.6% (monomer ratio 3%). The squeezing ratio was 90%. Then, the cotton woven fabric was subjected to heat treatment at 160° C. for 3 minutes. After the heat treatment had been performed, washing with 60° C. hot water was performed. Then, the reaction ratio was measured by the foregoing method, thus resulting in a value of 16% being obtained.

Then, the cotton woven fabric was dipped in a processing liquid containing, at a concentration of 5 g/l, cellulase (CELLSOFT-L manufactured by Novo Nordisk) so as to be processed at 60° C. for one hour. As a result, the weight of the woven fabric was reduced by 5.2% as compared with that before subjected to the enzyme process.

After the foregoing graft polymerization and weight reduction had been performed, dyeing and finishing were performed by usual methods. Then, each characteristic value was measured by the foregoing method. As a result, ΔMR=12.0%, B was 0.339 $g \cdot cm^2/cm$, W was 121 $g/m^2$ and B/W was 0.0028.

On the other hand, B of a woven fabric which was not subjected to the graft polymerization and weight reduction but subjected to scouring and bleaching was 0.880 $g \cdot cm^2/cm$, W was 110 $g/m^2$, and B/W was 0.0080.

Example 2

A scoured and bleached cotton woven fabric (yarn arrangement: warp yarns No. 45 count yarns, weft yarn No. 45 count yarns, plain woven fabric, weaving density: 115 warp yarns/inch×76 warp yarns/inch, weight: 110 $g/m^2$) was dipped in a processing liquid containing, at a concentration of 5 g/l, cellulase (CELLSOFT-L manufactured by Novo Nordisk) so as to be processed at 60° C. for one hour. As a result, the weight of the woven fabric was reduced by 6.5% as compared with that before subjected to the enzyme process.

Then, the foregoing cotton woven fabric was supplied by padding with water solution containing 2-acrylamide-2-methylpropanesulfonic acid by a concentration of 20% and ammonium persulfate by a concentration of 0.6% (monomer ratio 3%). The squeezing ratio was 90%. Then, the cotton woven fabric was subjected to heat treatment at 160° C. for 3 minutes. After the heat treatment had been performed, washing with 60° C. hot water was performed. Then, the reaction ratio was measured by the foregoing method, thus resulting in a value of 12% being obtained.

After the foregoing graft polymerization and weight reduction had been performed, dyeing and finishing were performed by usual methods. As a result, ΔMR 8.8%, B was 0.346 $g \cdot cm^2/cm$, W was 115 $g/m^2$ and B/W was 0.0030.

Comparative Example 1

A scoured and bleached cotton woven fabric (yarn arrangement: warp yarns No. 45 count yarns, weft yarn No. 45 count yarns, plain woven fabric, weaving density: 115 warp yarns/inch×76 warp yarns/inch, weight: 110 $g/m^2$) was supplied by padding with water solution containing 2-acrylamide-2-methylpropanesulfonic acid by a concentration of 20% and ammonium persulfate by a concentration of 0.6% (monomer ratio 3%). The squeezing ratio was 90%. Then, the cotton woven fabric was subjected to heat treatment at 160° C. for 3 minutes. After the heat treatment had been performed, washing with 60° C. hot water was performed. Then, the reaction ratio was measured by the foregoing method, thus resulting in a value of 16% being obtained.

Then, each characteristic value was measured by the foregoing method. As a result, ΔMR=11.5%, B was 1.177 $g \cdot cm^2/cm$, W was 128 $g/m^2$ and B/W was 0.0092.

In the foregoing case, although excellent hygroscopicity was obtained, handling touch was unsatisfactory.

Comparative Example 2

A scoured and bleached cotton woven fabric (yarn arrangement: warp yarns No. 45 count yarns, weft yarn No. 45 count yarns, plain woven fabric, weaving density: 115 warp yarns/inch×76 warp yarns/inch, weight: 110 $g/m^2$) was dipped in a processing liquid containing, at a concentration of 5 g/l, cellulase (CELLSOFT-L manufactured by Novo Nordisk) so as to be processed at 60° C. for one hour. As a result, the weight of the woven fabric was reduced by 7.5% as compared with that before subjected to the enzyme process.

Then, each characteristic value was measured by the foregoing method, thus resulting in that ΔMR=3.4%, B was 0.275 g·cm$^2$/cm, W was 102 g/m$^2$ and B/W was 0.0027. Although pliable handling touch was realized, the hygroscopicity was unsatisfactory.

Examples 3 to 6

The same process as that according to Example 1 was performed except the type of the hydrophilic vinyl monomers being changed. The results are shown in Table 1. Each sample had excellent hygroscopicity and pliable handling touch.

Examples 7 to 10

The same process as that according to Example 1 was performed except the pH of the water solution containing the hydrophilic vinyl monomers and the initiator being changed. The results are shown in Table 2. Each sample had excellent hygroscopicity and pliable handling touch.

Examples 11 to 14

The same process as that according to Example 1 was performed except the concentration of the hydrophilic vinyl monomers in the water solution being changed. The results are shown in Table 3. Each sample had excellent hygroscopicity and pliable handling touch.

Examples 15 to 18

The same process as that according to Example 1 was performed except the concentration of the initiator with respect to the hydrophilic vinyl monomers being changed. The results are shown in Table 4. Each sample had excellent hygroscopicity and pliable handling touch.

Examples 19 to 22

The same process as that according to Example 1 was performed except the heat treatment temperature being changed. The results are shown in Table 5. Each sample had excellent hygroscopicity and pliable handling touch.

Example 23

A scoured and bleached plain weave fabric (weaving density: 115 warp yarns×76 weft yarns/inch, weight 110 g/m$^2$), including, as warp yarns and weft yarns thereof, No. 45 count cotton/polyester blended yarns (blending ratio: cotton 55 wt %/polyester (0.17 tex, fiber length 40 mm) 45 wt %), was supplied by padding with water solution containing 2-acrylamide-2-methylpropanesulfonic acid by a concentration of 20% and ammonium persulfate by a concentration of 0.6% (monomer ratio 3%). The squeezing ratio was 90%. Then, the cotton woven fabric was subjected to heat treatment at 160° C. for 3 minutes. After the heat treatment had been performed, washing with 60° C. hot water was performed. Then, the reaction ratio was measured by the foregoing method, thus resulting in a value of 8% being obtained.

Then, the cotton woven fabric was dipped in a processing liquid containing, at a concentration of 5 g/l, cellulase (CELLSOFT-L manufactured by Novo Nordisk) so as to be processed at 60° C. for two hours. As a result, the weight of the woven fabric was reduced by 8.0% as compared with that before subjected to the enzyme process.

After the foregoing graft polymerization and the weight reduction had been performed, dyeing and finishing were performed by usual methods. Then, each characteristic value was measured by the foregoing method, thus resulting in that ΔMR=6.5%, B was 0.306 g·cm$^2$/cm, W was 109 g/m$^2$ and B/W was 0.0028.

On the other hand, B of a woven fabric which was not subjected to the graft polymerization and weight reduction but subjected to scouring and bleaching was 0.913 g·cm$^2$/cm, W was 110 g/m$^2$, and B/W was 0.0083.

Example 24

A scoured and bleached plain weave fabric (weaving density: 115 warp yarns×76 weft yarns/inch, weight 110 g/m$^2$), including, as warp yarns and weft yarns thereof, No. 45 count cotton/polyester blended yarns (blending ratio: cotton 55 wt %/polyester (0.17 tex, fiber length 40 mm) 45 wt %), was dipped in a processing liquid containing, at a concentration of 5 g/l, cellulase (CELLSOFT-L manufactured by Novo Nordisk) so as to be processed at 60° C. for two hours. As a result, the weight of the woven fabric was reduced by 9.5% as compared with that before subjected to the enzyme process.

Then, the foregoing woven fabric was supplied by padding with water solution containing 2-acrylamide-2-methylpropanesulfonic acid by a concentration of 20% and ammonium persulfate by a concentration of 0.6% (monomer ratio 3%). The squeezing ratio was 90%. Then, the cotton woven fabric was subjected to heat treatment at 160° C. for 3 minutes. After the heat treatment had been performed, washing with 60° C. hot water was performed. Then, the reaction ratio was measured by the foregoing method, thus resulting in a value of 7% being obtained.

After the foregoing graft polymerization and the weight reduction had been performed, dyeing and finishing were performed by usual methods. As a result, ΔMR=4.5%, B was 0.320 g·cm$^2$/cm, W was 107 g/m$^2$ and B/W was 0.0030.

Example 25

The same process as that according to Example 23 was performed except the woven fabric being dipped in water solution containing sodium hydrate at a concentration of 5 g/l so as to be processed at 95° C. for one hour in place of performing the process using the cellulase. The weight reduction ratio was 15.2% at this time.

Each characteristic value was measured by the foregoing method, thus resulting in that ΔMR=6.9%, B was 0.242 g·cm$^2$/cm, W was 101 g/m$^2$ and B/W was 0.0024.

Comparative Example 3

A scoured and bleached plain weave fabric (weaving density: 115 warp yarns×76 weft yarns/inch, weight 110 g/m$^2$), including, as warp yarns and weft yarns thereof, No. 45 count cotton/polyester blended yarns (blending ratio: cotton 55 wt %/polyester (0.17 tex, fiber length 40 mm) 45 wt %), was supplied by adding with water solution containing 2-acrylamide-2-methylpropanesulfonic acid by a concentration of 20% and ammonium persulfate by a concentration of 0.6% (monomer ratio 3%). The squeezing ratio was 90%. Then, the cotton woven fabric was subjected to heat treatment at 160° C. for 3 minutes. After the heat treatment had been performed, washing with 60° C. hot water was performed. Then, the reaction ratio was measured by the foregoing method, thus resulting in a value of 8% being obtained.

Then, each characteristic value was measured by the foregoing method, thus resulting in that ΔMR=6.2%, B was 1.093 g·cm$^2$/cm, W was 119 g/m$^2$ and B/W was 0.0092.

Although excellent hygroscopicity was realized, the handling touch was unsatisfactory.

Comparative Example 4

A scoured and bleached plain weave fabric (weaving density: 115 warp yarns×76 weft yarns/inch, weight 110 g/m$^2$), including, as warp yarns and weft yarns thereof, No. 45 count cotton/polyester blended yarns (blending ratio: cotton 55 wt %/polyester (0.17 tex, fiber length 40 mm) 45 wt %), was dipped in a processing liquid containing, at a concentration of 5 g/l, cellulase (CELLSOFT-L manufactured by Novo Nordisk) so as to be processed at 60° C. for two hours. As a result, the weight of the woven fabric was reduced by 9.5% as compared with that before subjected to the enzyme process.

Then, each characteristic value was measured by the foregoing method, thus resulting in that ΔMR=2.8%, B was 0.239 g·cm$^2$/cm, W was 100 g/m$^2$ and B/W was 0.0024.

Although pliable handling touch was realized, the hygroscopicity was unsatisfactory.

Comparative Example 5

The same process as that according to Comparative Example 4 was performed except the woven fabric being dipped in water solution containing sodium hydrate at a concentration of 5 g/l so as to be processed at 95° C. for one hour in place of performing the process using the cellulase. The weight reduction ratio at this time was 14.5%.

Then, each characteristic value was measured by the foregoing method, thus resulting in that ΔMR=3.4%, B was 0.207 g·cm$^2$/cm, W was 94 g/m$^2$ and B/W was 0.0022. Although pliable handling touch was realized, the hygroscopicity was unsatisfactory.

Examples 26 to 28

The same process as that according to Example 23 was performed except the blending ratio of the polyester fibers being changed. The results are shown in Table 6. Each sample had excellent hygroscopicity and pliable handling touch.

Examples 29 to 32

The same process as that according to Example 23 was performed except the type of the hydrophilic vinyl monomers being changed. The results are shown in Table 7. Each sample had excellent hygroscopicity and pliable handling touch.

Examples 33 to 36

The same process as that according to Example 23 was performed except the pH of the water solution containing the hydrophilic vinyl monomers and the initiator being changed. The results are shown in Table 8. Each sample had excellent hygroscopicity and pliable handling touch.

Examples 37 to 40

The same process as that according to Example 23 was performed except the concentration of the hydrophilic vinyl monomers in the water solution being changed. The results are shown in Table 9. Each sample had excellent hygroscopicity and pliable handling touch.

Examples 41 to 44

The same process as that according to Example 23 was performed except the concentration of the initiator with respect to the hydrophilic vinyl monomers being changed. The results are shown in Table 10. Each sample had excellent hygroscopicity and pliable handling touch.

Examples 45 to 48

The same process as that according to Example 23 was performed except the heat treatment temperature being changed. The results are shown in Table 11. Each sample had excellent hygroscopicity and pliable handling touch.

Example 49

A scoured and bleached cotton weave fabric (yarn arrangement: warp yarns No. 45 count yarns, weft yarn No. 45 count yarns, plain woven fabric, weaving density: 115 warp yarns/inch×76 warp yarns/inch, weight: 110 g/m$^2$) was supplied by padding with water solution containing dimethylol dihydroxyethylene urea by 6% and 6-hydrate magnesium chloride serving as a catalyzer by 2%. The squeezing ratio was 90%. Then, the cotton woven fabric was dried at 100° C. for 3 minutes and subjected to heat treatment at 160° C. for one minute.

Then, the cotton woven fabric was dipped in a processing liquid containing, at a concentration of 5 g/l, cellulase (CELLSOFT-L manufactured by Novo Nordisk) so as to be processed at 60° C. for one hour. As a result, the weight of the woven fabric was reduced by 5.2% as compared with that before subjected to the enzyme process.

After the two processes had been performed, dyeing and finishing were performed by usual methods. Then, the shrinkage ratio and the bending rigidity were measured by the foregoing methods, thus resulting in that the percentage of laundry shrinkage was 1.0% in the longitudinal direction and 0.8% in the lateral direction, B was 0.270 g·cm$^2$/cm, W was 104 g/m$^2$ and B/W was 0.0026.

On the other hand, the percentage of laundry shrinkage of a cotton woven fabric which had not subjected to the two processes and which was immediately after the scouring and bleaching had been performed was 5.5% in the longitudinal direction and 5.0% in the lateral direction, B was 0.902 g·cm$^2$/cm, W was 110 g/m$^2$ and B/W was 0.0082.

Example 50

A scoured and bleached cotton weave fabric (yarn arrangement: warp yarns No. 45 count yarns, weft yarn No. 45 count yarns, plain woven fabric, weaving density: 115 warp yarns/inch×76 warp yarns/inch, weight: 110 g/m$^2$) was dipped in a processing liquid containing, at a concentration of 5 g/l, cellulase (CELLSOFT-L manufactured by Novo Nordisk) so as to be processed at 60° C. for one hour. As a result, the weight of the woven fabric was reduced by 7.5% as compared with that before subjected to the enzyme process.

Then, the foregoing cotton woven fabric was supplied by padding with water solution containing dimethylol dihydroxyethylene urea by 6% and 6-hydrate magnesium chloride serving as a catalyzer by 2%. The squeezing ratio was 90%. Then, the cotton woven fabric was dried at 100° C. for 3 minutes and subjected to heat treatment at 160° C. for one minute.

After the two processes had been performed, dyeing and finishing were performed by usual methods. As a result, the percentage of laundry shrinkage was 0.8% in the longitudinal direction and 0.7% in the lateral direction, B was 0.305 $g \cdot cm^2/cm$, W was 102 $g/m^2$ and B/W was 0.0030.

Example 51

A scoured and bleached cotton weave fabric (yarn arrangement: warp yarns No. 45 count yarns, weft yarn No. 45 count yarns, plain woven fabric, weaving density: 115 warp yarns/inch×76 warp yarns/inch, weight: 110 $g/m^2$) was, for 5 minutes, exposed to formaldehyde vapor generated from paraformaldehyde in a sealed reacting chamber. The temperature of the reacting chamber during the subjection was 60° C. Then, sulfurous acid gas was introduced into the reacting chamber to subject the woven fabric, and the temperature of the reacting chamber was raised to 160° C. so as to be processed for 3 minutes.

Then, the foregoing cotton woven fabric was dipped in a processing liquid containing, at a concentration of 5 g/l, cellulase (CELLSOFT-L manufactured by Novo Nordisk) so as to be processed at 60° C. for one hour. As a result, the weight of the woven fabric was reduced by 6.5% as compared with that before subjected to the enzyme process.

After the two processes had been performed, dyeing and finishing were performed by usual methods. Then, the shrinkage ratio and the bending rigidity were measured by the foregoing methods, thus resulting in that the percentage of laundry shrinkage was 1.0% in the longitudinal direction and 0.9% in the lateral direction, B was 0.237 $g \cdot cm^2/cm$, W was 103 $g/m^2$ and B/W was 0.0023.

Example 52

A scoured and bleached cotton weave fabric (yarn arrangement: warp yarns No. 45 count yarns, weft yarn No. 45 count yarns, plain woven fabric, weaving density: 115 warp yarns/inch×76 warp yarns/inch, weight: 110 $g/m^2$) was dipped in a processing liquid containing, at a concentration of 5 g/l, cellulase (CELLSOFT-L manufactured by Novo Nordisk) so as to be processed at 60° C. for one hour. As a result, the weight of the woven fabric was reduced by 7.3% as compared with that before subjected to the enzyme process.

Then, the cotton woven fabric was introduced into a sealed reacting chamber so that it was, for 5 minutes, exposed to formaldehyde vapor generated from paraformaldehyde. The temperature of the reacting chamber during the subjection was 60° C. Then, sulfurous acid gas was introduced into the reacting chamber to subject the woven fabric, and the temperature of the reacting chamber was raised to 160° C. so as to be processed for 3 minutes.

After the two processes had been performed, dyeing and finishing were performed by usual methods. As a result, the percentage of laundry shrinkage was 0.8% in the longitudinal direction and 0.8% in the lateral direction, B was 0.286 $g \cdot cm^2/cm$, W was 102 $g/m^2$ and B/W was 0.0028.

Comparative Example 6

A scoured and bleached cotton weave fabric (yarn arrangement: warp yarns No. 45 count yarns, weft yarn No. 45 count yarns, plain woven fabric, weaving density: 115 warp yarns/inch×76 warp yarns/inch, weight: 110 $g/m^2$) was, by padding, supplied with water solution containing dimethylol dihydroxyethylene urea by 6% and 6-hydrate magnesium chloride serving as a catalyzer by 2%. The squeezing ratio was 90%. Then, the cotton woven fabric was dried at 100° C. for 3 minutes and subjected to heat treatment at 160° C. for one minute.

Then, the percentage of laundry shrinkage and the bending rigidity were measured, thus resulting in that the percentage of laundry shrinkage was 0.9% in the longitudinal direction and 0.9% in the lateral direction, B was 0.957 $g \cdot cm^2/cm$, W was 110 $g/m^2$ and B/W was 0.0087. In the foregoing case, shape memory was realized but the handling touch was unsatisfactory.

Comparative Example 7

A scoured and bleached cotton weave fabric (yarn arrangement: warp yarns No. 45 count yarns, weft yarn No. 45 count yarns, plain woven fabric, weaving density: 115 warp yarns/inch×76 warp yarns/inch, weight: 110 $g/m^2$) was, for 5 minutes, exposed to formaldehyde vapor generated from paraformaldehyde in a sealed reacting chamber. The temperature of the reacting chamber during the subjection was 60° C. Then, sulfurous acid gas was introduced into the reacting chamber to subject the woven fabric, and the temperature of the reacting chamber was raised to 160° C. so as to be processed for 3 minutes.

Then, the percentage of laundry shrinkage and the bending rigidity were measured, thus resulting in that the percentage of laundry shrinkage was 1.0% in the longitudinal direction and 1.0% in the lateral direction, B was 0.913 $g \cdot cm^2/cm$, W was 110 $g/m^2$ and B/W was 0.0083. In the foregoing case, shape memory was realized but the handling touch was unsatisfactory.

Comparative Example 8

A scoured and bleached cotton weave fabric (yarn arrangement: warp yarns No. 45 count yarns, weft yarn No. 45 count yarns, plain woven fabric, weaving density: 115 warp yarns/inch×76 warp yarns/inch, weight: 110 $g/m^2$) was dipped in a processing liquid containing, at a concentration of 5 g/l, cellulase (CELLSOFT-L manufactured by Novo Nordisk) so as to be processed at 60° C. for one hour. As a result, the weight of the woven fabric was reduced by 7.5% as compared with that before subjected to the enzyme process.

Then, the percentage of laundry shrinkage and the bending rigidity were measured, thus resulting in that the percentage of laundry shrinkage was 5.5% in the longitudinal direction and 5.3% in the lateral direction, B was 0.275 $g \cdot cm^2/cm$, W was 102 $g/m^2$ and B/W was 0.0027. In the foregoing case, pliable handling touch was realized but shape memory was unsatisfactory.

Examples 53 to 56

The same process as that according to Example 49 was performed except the type of the hydrophilic vinyl monomers being changed. The results are shown in Table 12. Each sample had excellent shape memory and pliable handling touch.

Examples 57 to 60

The same process as that according to Example 49 was performed except the drying temperature and the heat treatment temperature being changed. The results are shown in Table 13. Each sample had excellent shape memory and pliable handling touch.

Examples 61 to 63

The same process as that according to Example 51 except the temperature of formaldehyde vapor and the heat treatment temperature being changed. The results are shown in Table 14. Each sample had excellent shape memory and pliable handling touch.

Example 64

A scoured and bleached plain weave fabric (weaving density: 115 warp yarns×76 weft yarns/inch, weight 110 g/m$^2$), including, as warp yarns and weft yarns thereof, No. 45 count cotton/polyester blended yarns (blending ratio: cotton 55 wt %/polyester (0.17 tex, fiber length 40 mm) 45 wt %), was supplied by padding with water solution containing dimethylol dihydroxyethylene urea by 6% and 6-hydrate ammonium persulfate by a concentration of 2%. The squeezing ratio was 90%. Then, the woven fabric was dried at 100° C. for 3 minutes, and subjected to heat treatment at 160° C. for one minute.

Then, the woven fabric was dipped in a processing liquid containing, at a concentration of 5 g/l, cellulase (CELLSOFT-L manufactured by Novo Nordisk) so as to be processed at 60° C. for two hours. As a result, the weight of the woven fabric was reduced by 10.2% as compared with that before subjected to the enzyme process.

After the two processes had been performed, dyeing and finishing were performed by usual methods. Then, the percentage of laundry shrinkage and the bending rigidity were measured by the foregoing methods. As a result, the percentage of laundry shrinkage was 0.5% in the longitudinal direction and 0.4% in the lateral direction, B was 0.277 g·cm$^2$/cm, W was 99 g/m$^2$ and B/W was 0.0028.

On the other hand, the percentage of laundry shrinkage of a woven fabric which had not subjected to the two processes and which was immediately after the scouring and bleaching had been performed was 4.5% in the longitudinal direction and 4.1% in the lateral direction, B was 0.902 g·cm$^2$/cm, W was 110 g/m$^2$ and B/W was 0.0082.

Example 65

A scoured and bleached plain weave fabric (weaving density: 115 warp yarns×76 weft yarns/inch, weight 110 g/m$^2$), including, as warp yarns and weft yarns thereof, No. 45 count cotton/polyester combined yarns (mixture ratio: cotton 55 wt %/polyester (0.17 tex, fiber length 40 mm) 45 wt %), was dipped in a processing liquid containing, at a concentration of 5 g/l, cellulase (CELLSOFT-L manufactured by Novo Nordisk) so as to be processed at 60° C. for two hours. As a result, the weight of the woven fabric was reduced by 11.5% as compared with that before subjected to the enzyme process.

Then, the foregoing woven fabric was supplied water solution containing dimethylol dihydroxyethylene urea by 6% and 6-hydrate ammonium persulfate by a concentration of 2% by padding. The squeezing ratio was 90%. Then, the woven fabric was dried at 100° C. for 3 minutes, and subjected to heat treatment at 160° C. for one minute.

After the two processes had been performed, dyeing and finishing were performed by usual methods, and the percentage of laundry shrinkage was 0.4% in the longitudinal direction and 0.3% in the lateral direction, B was 0.292 g·cm$^2$/cm, W was 97 g/m$^2$ and B/W was 0.0030.

Example 66

A scoured and bleached plain weave fabric (weaving density: 115 warp yarns×76 weft yarns/inch, weight 110 g/m$^2$), including, as warp yarns and weft yarns thereof, No. 45 count cotton/polyester blended yarns (blending ratio: cotton 55 wt %/polyester (0.17 tex, fiber length 40 mm) 45 wt %) was, for 5 minutes, exposed to formaldehyde vapor generated from paraformaldehyde in a sealed reacting chamber. The temperature of the reacting chamber during the subjection was 60° C. Then, sulfurous acid gas was introduced into the reacting chamber to subject the woven fabric, and the temperature of the reacting chamber was raised to 160° C. so as to be processed for 3 minutes.

Then, the foregoing woven fabric was dipped in a processing liquid containing, at a concentration of 5 g/l, cellulase (CELLSOFT-L manufactured by Novo Nordisk) so as to be processed at 60° C. for two hours. As a result, the weight of the woven fabric was reduced by 10.5% as compared with that before subjected to the enzyme process.

After the two processes had been performed, dyeing and finishing were performed by usual methods. Then, the percentage of laundry shrinkage and the bending rigidity were measured by the foregoing methods. As a result, the percentage of laundry shrinkage was 0.5% in the longitudinal direction and 0.4% in the lateral direction, B was 0.246 g·cm$^2$/cm, W was 98 g/m$^2$ and B/W was 0.0025.

Example 67

A scoured and bleached plain weave fabric (weaving density: 115 warp yarns×76 weft yarns/inch, weight 110 g/m$^2$), including, as warp yarns and weft yarns thereof, No. 45 count cotton/polyester blended yarns (blending ratio: cotton 55 wt %/polyester (0.17 tex, fiber length 40 mm) 45 wt %), was dipped in a processing liquid containing, at a concentration of 5 g/l, cellulase (CELLSOFT-L manufactured by Novo Nordisk) so as to be processed at 60° C. for two hours. As a result, the weight of the woven fabric was reduced by 11.5% as compared with that before subjected to is the enzyme process.

Then, the woven fabric was introduced into a sealed reacting chamber so that it was, for 5 minutes, exposed to formaldehyde vapor generated from paraformaldehyde. The temperature of the reacting chamber during the subjection was 60° C. Then, sulfurous acid gas was introduced into the reacting chamber to subject the woven fabric, and the temperature of the reacting chamber was raised to 160° C. so as to be processed for 3 minutes.

After the two processes had been performed, dyeing and finishing were performed by usual methods, and the percentage of laundry shrinkage and the bending rigidity were measured by the foregoing methods. As a result, the percentage of laundry shrinkage was 0.4% in the longitudinal direction and 0.4% in the lateral direction, B was 0.292 g·cm$^2$/cm, W was 97 g/m$^2$ and B/W was 0.0030.

Comparative Example 9

A scoured and bleached plain weave fabric (weaving density: 115 warp yarns×76 weft yarns/inch, weight 110 g/m$^2$), including, as warp yarns and weft yarns thereof, No. 45 count cotton/polyester blended yarns (blending ratio: cotton 55 wt %/polyester (0.17 tex, fiber length 40 mm) 45 wt %), was supplied by padding with water solution containing dimethylol dihydroxyethylene urea by 6% and 6-hydrate magnesium chloride serving as a catalyzer by 2%. The squeezing ratio was 90%. Then, the woven fabric was dried at 100° C. for 3 minutes, and subjected to heat treatment at 160° C. for one minute.

Then, the percentage of laundry shrinkage and the bending rigidity were measured by the foregoing methods. As a result, the percentage of laundry shrinkage was 0.5% in the longitudinal direction and 0.5% in the lateral direction, B was 0.770 g·cm$^2$/cm, W was 110 g/m$^2$ and B/W was 0.0070. In the foregoing case, the shape memory was realized, but the handling touch was unsatisfactory.

Comparative Example 10

A scoured and bleached plain weave fabric (weaving density: 115 warp yarns×76 weft yarns/inch, weight 110 g/m$^2$), including, as warp yarns and weft yarns thereof, No. 45 count cotton/polyester blended yarns (blending ratio: cotton 55 wt %/polyester (0.17 tex, fiber length 40 mm) 45 wt %), was, for 5 minutes, exposed to formaldehyde vapor generated from paraformaldehyde in a sealed reacting chamber. The temperature of the reacting chamber during the subjection was 60° C. Then, sulfurous acid gas was introduced into the reacting chamber to subject the woven fabric, and the temperature of the reacting chamber was raised to 160° C. so as to be processed for 3 minutes.

Then, the percentage of laundry shrinkage and the bending rigidity were measured, thus resulting in that the percentage of laundry shrinkage was 0.5% in the longitudinal direction and 0.4% in the lateral direction, B was 0.737 g·cm$^2$/cm, W was 110 g/m$^2$ and B/W was 0.0067. Although the shape memory was realized in the foregoing case, the handling touch was unsatisfactory.

Comparative Example 11

A scoured and bleached plain weave fabric (weaving density: 115 warp yarns×76 weft yarns/inch, weight 110 g/m$^2$), including, as warp yarns and weft yarns thereof, No. 45 count cotton/polyester blended yarns (blending ratio: cotton 55 wt %/polyester (0.17 tex, fiber length 40 mm) 45 wt %), was dipped in a processing liquid containing, at a concentration of 5 g/l, cellulase (CELLSOFT-L manufactured by Novo Nordisk) so as to be processed at 60° C. for two hours. As a result, the weight of the woven fabric was reduced by 11.5% as compared with that before subjected to the enzyme process.

Then, the percentage of laundry shrinkage and the bending rigidity were measured by the foregoing methods. As a result, the percentage of laundry shrinkage was 4.5% in the longitudinal direction and 4.2% in the lateral direction, B was 0.224 g·cm$^2$/cm, W was 97 g/m$^2$ and B/W was 0.0023. Although pliable handling touch was realized, the shape memory was unsatisfactory.

Comparative Example 12

The same process as that according to Comparative Example 11 was performed except the woven fabric being dipped in water solution containing sodium hydrate at a concentration of 5 g/l so as to be processed at 95° C. for one hour in place of being processed with the cellulose. The weight reduction ratio at this time was 13.5%.

As a result, the percentage of laundry shrinkage was 4.5% in the longitudinal direction and 4.3% in the lateral direction, B was 0.228 g·cm$^2$/cm, W was 95 g/m$^2$ and B/W was 0.0024. Although pliable handling touch was realized in this case, the shape memory was unsatisfactory.

Examples 68 to 71

In place of performing the process using the cellulase in Examples 64 to 67, the woven fabric was dipped in water solution containing sodium hydrate at a concentration of 5 g/l so as to be processed at 95° C. for one hour. The results are shown in Table 15. Each sample had excellent shape memory and pliable handling touch.

Examples 72 to 74

The same process as that according to Example 64 was performed except the blending ratio of the polyester fibers being changed. The results are shown in Table 16. Each sample had excellent shape memory and pliable handling touch.

Examples 75 to 78

The same process as that according to Example 64 was performed except the type of the fiber reactant type resin being changed. The results are shown in Table 17. Each sample had excellent shape memory and pliable handling touch.

Examples 79 to 82

The same process as that according to Example 64 was performed except the drying temperature and the heat treatment temperature being changed. The results are shown in Table 18. Each sample had excellent shape memory and pliable handling touch.

Examples 83 to 85

The same process as that according to Example 66 was performed except the temperature of the formaldehyde vapor and the heat treatment temperature being changed. The results are shown in Table 19. Each sample had excellent shape memory and pliable handling touch.

INDUSTRIAL APPLICABILITY

According to the present invention, a fabric can be provided which has excellent hygroscopicity, satisfactory pliable handling touch and shape memory and which can be applied widely to clothes.

TABLE 1

| | hydrophilic vinyl monomer | reaction ratio (%) | ΔMR (%) | weight reduction ratio (%) | B/W |
|---|---|---|---|---|---|
| Example 3 | sodium acrylate | 11 | 7.0 | 5.0 | 0.0030 |
| Example 4 | sodium allyl sulfonate | 12 | 8.0 | 4.9 | 0.0031 |
| Example 5 | allyl alcohol | 7 | 6.0 | 5.3 | 0.0028 |
| Example 6 | acrylamide | 6 | 4.8 | 5.8 | 0.0025 |

TABLE 2

| | pH | reaction ratio (%) | ΔMR (%) | weight reduction ratio (%) | B/W |
|---|---|---|---|---|---|
| Example 7 | 5 | 12 | 8.0 | 4.8 | 0.0032 |
| Example 8 | 6 | 15 | 9.6 | 4.0 | 0.0038 |
| Example 9 | 12 | 16 | 9.8 | 4.2 | 0.0035 |
| Example 10 | 14 | 12 | 8.2 | 5.0 | 0.0030 |

TABLE 3

| | concentration (wt %) | reaction ratio (%) | ΔMR (%) | weight reduction ratio (%) | B/W |
|---|---|---|---|---|---|
| Example 11 | 5 | 10 | 7.0 | 5.2 | 0.0028 |
| Example 12 | 10 | 15 | 9.0 | 4.5 | 0.0031 |

TABLE 3-continued

| | concentration (wt %) | reaction ratio (%) | ΔMR (%) | weight reduction ratio (%) | B/W |
|---|---|---|---|---|---|
| Example 13 | 30 | 16 | 10.1 | 4.3 | 0.0038 |
| Example 14 | 35 | 11 | 8.0 | 5.0 | 0.0031 |

TABLE 4

| | concentration (wt %) | reaction ratio (%) | ΔMR (%) | weight reduction ratio (%) | B/W |
|---|---|---|---|---|---|
| Example 15 | 0.5 | 9 | 5.7 | 5.2 | 0.0029 |
| Example 16 | 1 | 15 | 10.3 | 4.1 | 0.0031 |
| Example 17 | 5 | 15 | 11.0 | 4.3 | 0.0037 |
| Example 18 | 8 | 12 | 8.3 | 5.0 | 0.0030 |

TABLE 5

| | temperature (° C.) | reaction ratio (%) | ΔMR (%) | weight reduction ratio (%) | B/W |
|---|---|---|---|---|---|
| Example 19 | 70 | 6 | 5.0 | 5.2 | 0.0027 |
| Example 20 | 80 | 14 | 8.8 | 8.8 | 0.0030 |
| Example 21 | 200 | 15 | 10.1 | 10.1 | 0.0043 |
| Example 22 | 210 | 11 | 7.2 | 7.2 | 0.0039 |

TABLE 6

| | blending ratio of polyester fibers (wt %) | reaction ratio (%) | ΔMR (%) | weight reduction ratio (%) | B/W |
|---|---|---|---|---|---|
| Example 26 | 10 | 14 | 12.3 | 14.2 | 0.0023 |
| Example 27 | 30 | 11 | 7.1 | 10.8 | 0.0025 |
| Example 28 | 85 | 3 | 2.5 | 4.0 | 0.0043 |

TABLE 7

| | hydrophilic vinyl monomer | reaction ratio (%) | ΔMR (%) | weight reduction ratio (%) | B/W |
|---|---|---|---|---|---|
| Example 29 | sodium acrylate | 5 | 3.8 | 9.2 | 0.0028 |
| Example 30 | sodium allyl sulfonate | 6 | 4.0 | 9.3 | 0.0027 |
| Example 31 | allyl alcohol | 5 | 3.9 | 9.8 | 0.0025 |
| Example 32 | acrylamide | 4 | 2.5 | 10.2 | 0.0022 |

TABLE 8

| | pH | reaction ratio (%) | ΔMR (%) | weight reduction ratio (%) | B/W |
|---|---|---|---|---|---|
| Example 33 | 5 | 7 | 4.2 | 8.0 | 0.0028 |
| Example 34 | 6 | 9 | 5.8 | 7.2 | 0.0030 |
| Example 35 | 12 | 8 | 5.1 | 7.6 | 0.0035 |
| Example 36 | 14 | 6 | 4.3 | 9.1 | 0.0030 |

TABLE 9

| | concentration (wt %) | reaction ratio (%) | ΔMR (%) | weight reduction ratio (%) | B/W |
|---|---|---|---|---|---|
| Example 37 | 5 | 5 | 3.8 | 9.1 | 0.0025 |
| Example 38 | 10 | 8 | 5.1 | 8.5 | 0.0030 |
| Example 39 | 30 | 7 | 5.0 | 8.0 | 0.0037 |
| Example 40 | 35 | 7 | 4.5 | 7.4 | 0.0040 |

TABLE 10

| | concentration (wt %) | reaction ratio (%) | ΔMR (%) | weight reduction ratio (%) | B/W |
|---|---|---|---|---|---|
| Example 41 | 0.5 | 5 | 3.8 | 9.2 | 0.0025 |
| Example 42 | 1 | 7 | 5.0 | 8.3 | 0.0028 |
| Example 43 | 5 | 8 | 5.5 | 8.0 | 0.9030 |
| Example 44 | 8 | 6 | 4.1 | 9.5 | 0.0024 |

TABLE 11

| | temperature (° C.) | reaction ratio (%) | ΔMR (%) | weight reduction ratio (%) | B/W |
|---|---|---|---|---|---|
| Example 45 | 70 | 3 | 2.8 | 10.2 | 0.0021 |
| Example 46 | 80 | 8 | 4.5 | 9.0 | 0.0024 |
| Example 47 | 200 | 9 | 10.1 | 8.2 | 0.0028 |
| Example 48 | 210 | 6 | 7.2 | 8.9 | 0.0032 |

TABLE 12

| | hydrophilic vinyl monomers | percentage of laundry shrinkage longitudinal (%) | percentage of laundry shrinkage lateral (%) | weight reduction ratio (%) | B/W |
|---|---|---|---|---|---|
| Example 53 | dimethylol ethylene urea | 1.0 | 0.9 | 5.0 | 0.0031 |
| Example 54 | dimethylol uron | 1.0 | 0.9 | 6.3 | 0.0027 |
| Example 55 | dimethylol triazone | 1.1 | 1.0 | 5.8 | 0.0030 |
| Example 56 | dimethylol propylene urea | 0.9 | 0.8 | 5.3 | 0.0042 |

TABLE 13

| | drying temperature (° C.) | heat treatment temperature (° C.) | percentage of laundry shrinkage: longitudinal (%) | percentage of laundry shrinkage: lateral (%) | weight reduction ratio (%) | B/W |
|---|---|---|---|---|---|---|
| Example 57 | 30 | 60 | 1.8 | 1.6 | 6.1 | 0.0025 |
| Example 58 | 100 | 120 | 1.2 | 1.2 | 5.5 | 0.0027 |
| Example 59 | 100 | 180 | 0.9 | 0.9 | 5.0 | 0.0030 |
| Example 60 | 100 | 210 | 0.9 | 0.8 | 5.4 | 0.0034 |

TABLE 14

| | temperature of vapor (° C.) | heat treatment temperature (° C.) | percentage of laundry shrinkage: longitudinal (%) | percentage of laundry shrinkage: lateral (%) | weight reduction ratio (%) | B/W |
|---|---|---|---|---|---|---|
| Example 61 | 30 | 60 | 1.9 | 1.8 | 6.4 | 0.0023 |
| Example 62 | 60 | 120 | 1.0 | 1.0 | 6.0 | 0.0025 |
| Example 63 | 60 | 180 | 0.9 | 0.8 | 5.2 | 0.0032 |

TABLE 15

| | percentage of laundry shrinkage: longitudinal (%) | percentage of laundry shrinkage: lateral (%) | weight reduction ratio (%) | B/W |
|---|---|---|---|---|
| Example 68 | 0.5 | 0.4 | 12.0 | 0.0023 |
| Example 69 | 0.4 | 0.3 | 14.0 | 0.0026 |
| Example 70 | 0.5 | 0.5 | 12.2 | 0.0024 |
| Example 71 | 0.4 | 0.4 | 14.3 | 0.0027 |

TABLE 16

| | blending ratio of polyester fibers (wt %) | percentage of laundry shrinkage: longitudinal (%) | percentage of laundry shrinkage: lateral (%) | weight reduction ratio (%) | B/W |
|---|---|---|---|---|---|
| Example 72 | 10 | 0.9 | 0.8 | 14.4 | 0.0028 |
| Example 73 | 30 | 0.6 | 0.6 | 10.2 | 0.0030 |
| Example 74 | 85 | 0.3 | 0.3 | 4.2 | 0.0046 |

TABLE 17

| | fiber: reactant type resin | percentage of laundry shrinkage: longitudinal (%) | percentage of laundry shrinkage: lateral (%) | weight reduction ratio (%) | B/W |
|---|---|---|---|---|---|
| Example 75 | dimethylol ethylene urea | 0.5 | 0.5 | 9.0 | 0.0030 |

TABLE 17-continued

| | fiber: reactant type resin | percentage of laundry shrinkage: longitudinal (%) | percentage of laundry shrinkage: lateral (%) | weight reduction ratio (%) | B/W |
|---|---|---|---|---|---|
| Example 76 | dimethylol uron | 0.5 | 0.4 | 10.3 | 0.0027 |
| Example 77 | dimethylol triazone | 0.6 | 0.5 | 9.8 | 0.0028 |
| Example 78 | dimethylol propylene urea | 0.4 | 0.3 | 8.2 | 0.0040 |

TABLE 18

| | drying temperature (° C.) | heat treatment temperature (° C.) | percentage of laundry shrinkage: longitudinal (%) | percentage of laundry shrinkage: lateral (%) | weight reduction ratio (%) | B/W |
|---|---|---|---|---|---|---|
| Example 79 | 30 | 60 | 0.8 | 0.8 | 14.1 | 0.0022 |
| Example 80 | 100 | 120 | 0.6 | 0.6 | 13.5 | 0.0030 |
| Example 81 | 100 | 180 | 0.4 | 0.4 | 12.0 | 0.0033 |
| Example 82 | 100 | 210 | 0.5 | 0.4 | 10.4 | 0.0036 |

TABLE 19

| | temperature of vapor (° C.) | heat treatment temperature (° C.) | percentage of laundry shrinkage: longitudinal (%) | percentage of laundry shrinkage: lateral (%) | weight reduction ratio (%) | B/W |
|---|---|---|---|---|---|---|
| Example 83 | 30 | 60 | 0.9 | 1.0 | 14.6 | 0.0023 |
| Example 84 | 60 | 120 | 0.5 | 0.6 | 13.0 | 0.0024 |
| Example 85 | 60 | 180 | 0.5 | 0.5 | 12.2 | 0.0030 |

What is claimed is:

1. A fabric comprising cellulose fibers, comprising 2-acrylamide-2-methylpropane sulfonic acid and/or its salt or sodium allylsulfonate graft-polymerized with said cellulose fibers, wherein the ratio B/W of bending rigidity (B) measured by the KES (Kawabata Evaluation System) and weight (W) is 0.0001 or higher and 0.005 or lower.

2. A fabric according to claim 1, wherein the ΔMR value obtained by subtracting the hygroscopic coefficient MR1 (%) of said fabric at a temperature of 20° C. and a humidity of 65% from the hygroscopic coefficient MR2 (%) of said fabric at 30° C. and humidity of 90% satisfies the following equation:

$$4<\Delta MR<14.$$

3. A fabric comprising cellulose fibers and polyester fibers, and further comprising 2-acrylamide-2-methylpropane sulfonic acid and/or its salt or sodium allylsulfonate graft-polymerized with said cellulose fibers, wherein the ratio B/W of bending rigidity (B) measured by the KES (Kawabata Evaluation System) and weight (W) is 0.0001 or higher and 0.005 or lower.

4. A fabric according to claim 3, wherein the ΔMR value obtained by subtracting the hygroscopic coefficient MR1 (%) of said fabric at a temperature of 20° C. and a humidity of 65% from the hygroscopic coefficient MR2 (%) of said fabric at 30° C. and a humidity of 90% satisfies the following equation:

$$0.04\times(100-x)<\Delta MR\leqq 0.14\times(100-x)$$

where x is the ratio (wt %) of said polyester fibers in said fabric.

5. A fabric according to claim 3, wherein the ratio of said polyester fibers is 10 wt % or higher and 90 wt % or lower.

6. A fabric according to claims 1 or 3, wherein the reaction ratio of said 2-acrylamide-2-methylpropane sulfonic acid and/or its salt or sodium allylsulfonate with respect to said fabric is 1 wt % or higher and 20 wt % or lower.

7. A fabric according to claim 1 or 3, wherein B/W is 0.0001 or higher and 0.004 or lower.

8. A fabric according to claim 1 or 3, wherein B/W is 0.0001 or higher and 0.003 or lower.

9. A fabric according to claim 1 or 3, wherein said 2-acrylamide-2-methylpropane sulfonic acid and/or its salt or sodium allylsulfonate is graft-polymerized to the inside of said cellulose fibers.

10. A process for producing a fabric comprising the step of reducing the weight of a fabric including cellulose fibers before or after said fabric is subjected to graft polymerization in which said fabric is subjected to an impregnation process using an aqueous solution containing 2-acrylamide-2-methylpropane sulfonic acid and/or its salt or sodium allylsulfonate and a polymerization initiator and subjected to heat treatment.

11. A process for producing a fabric comprising the step of reducing the weight of a fabric comprising polyester fibers and cellulose fibers before or after said fabric is subjected to graft polymerization in which said fabric is subjected to an impregnation process using an aqueous solution containing 2-acrylamide-2-methylpropane sulfonic acid and/or its salt or sodium allylsulfonate and a polymerization initiator and subjected to heat treatment.

12. A process for producing a fabric according to claim 11, wherein the ratio of said polyester fibers in said fabric is 10 wt % or higher to 90 wt % or lower.

13. A process for producing a fabric according to claim 10 or 11, wherein the pH of said aqueous solution is 6 or more to 12 or lower.

14. A process for producing a fabric according to claim 10 or 11, wherein the concentration of said 2-acrylamide-2-methylpropane sulfonic acid and/or its salt or sodium allylsulfonate in said aqueous solution is 10 wt % or higher to 30 wt % or lower.

15. A process for producing a fabric according to claim 10 or 11, wherein said polymerization initiator is present in an amount of 1 wt % or higher and 5 wt % or lower with respect to said 2-acrylamide-2-methylpropane sulfonic acid and/or its salt or sodium allylsulfonate.

16. A process for producing a fabric according to claim 10 or 11, wherein said heat treatment temperature is 80° C. or higher to 200° C. or lower.

17. A process for producing a fabric according to claim 10 or 11, wherein the reduction ratio is 3% or higher to 20% or lower.

18. A process for producing a fabric according to claim 10 or 11, wherein said weight reduction is weight reduction of cellulose fibers by using cellulase.

19. A process for producing a fabric according to claim 18, wherein said fabric is dipped in an aqueous solution containing said cellulase at a concentration of 1 g/l or more to 30 g/l or less so as to process said fabric at temperature of 30° C. or higher to 90° C. or lower.

20. A process for producing a fabric according to claim 11, wherein said weight reduction is weight reduction of said polyester fibers by using an alkali compound.

21. A process for producing a fabric according to claim 20, wherein said reduction ratio is 3% or higher to 20% or lower.

22. A process for producing a fabric according to claim 20, wherein said fabric is dipped in water solution containing said alkali compound at a concentration of 10 g/l or more to 300 g/l or less so as to process said fabric at temperature of 50° C. or higher to 200° C. or lower.

* * * * *

UNITED STATES PATENT AND TRADEMARK OFFICE

CERTIFICATE OF CORRECTION

PATENT NO. : 6,074,964
DATED : June 13, 2000
INVENTOR(S) : Hara et al

It is certified that error appears in the above-identified patent and that said Letters Patent is hereby corrected as shown below:

In Column 1, at line 9, please delete "as" after "invention".

In Column 23, at table 5, at "Example 19", please change "5.2" to -5.0-.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*